US007513744B2

(12) United States Patent
Cunha et al.

(10) Patent No.: US 7,513,744 B2
(45) Date of Patent: Apr. 7, 2009

(54) MICROCIRCUIT COOLING AND TIP BLOWING

(75) Inventors: Francisco J. Cunha, Avon, CT (US); Jason Edward Albert, West Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 366 days.

(21) Appl. No.: 11/489,155

(22) Filed: Jul. 18, 2006

(65) Prior Publication Data

US 2008/0019839 A1 Jan. 24, 2008

(51) Int. Cl.
*F01D 5/18* (2006.01)

(52) U.S. Cl. ..... 416/92; 416/97 R

(58) Field of Classification Search ..... 416/92, 416/96 R, 97 R

See application file for complete search history.

(56) References Cited

U.S. PATENT DOCUMENTS 5,813,835 A 9/1998 Corsmeier et al.
6,247,896 B1 * 6/2001 Auxier et al. ..... 416/97 R
6,705,836 B2 * 3/2004 Bourriaud et al. ..... 416/97 R
6,916,150 B2 7/2005 Liang
7,029,235 B2 * 4/2006 Liang ..... 416/92
7,033,136 B2 * 4/2006 Botrel et al. ..... 415/115
7,137,776 B2 * 11/2006 Draper et al. ..... 415/115

FOREIGN PATENT DOCUMENTS

EP 1445424 8/2004

* cited by examiner

*Primary Examiner*—Ninh H Nguyen
(74) *Attorney, Agent, or Firm*—Bachman & LaPointe, P.C.

(57) ABSTRACT

A turbine engine component has an airfoil portion having a pressure side, a suction side, a leading edge, a trailing edge, and a tip. The component further has a first cooling microcircuit embedded in a pressure side wall, a second cooling microcircuit embedded in a suction side wall, and a system for cooling the tip comprising a first tip cooling microcircuit receiving cooling fluid from the first cooling microcircuit and a second tip cooling microcircuit receiving cooling fluid from the second cooling microcircuit.

13 Claims, 3 Drawing Sheets

MICROCIRCUIT COOLING AND TIP BLOWING

BACKGROUND (1) Field of the Invention

The present invention relates to a cooling system used on turbine engine components, such as turbine blades, which allows for tip blowing on the pressure side of the tip.

(2) Prior Art

The overall cooling effectiveness is a measure used to determine the cooling characteristics of a particular design. The ideal non-achievable goal is unity, which implies that the metal temperature is the same as the coolant temperature inside an airfoil. The opposite can also occur where the cooling effectiveness is zero implying that the metal temperature is the same as the gas temperature. When that happens, the material will certainly melt and burn away. In general, existing cooling technology for turbine engine components, such as turbine blades, allows the cooling effectiveness to be between 0.5 and 0.6. More advanced technology, such as supercooling, should be between 0.6 and 0.7. Microcircuit cooling as the most advanced cooling technology in existence today can be made to produce cooling effectiveness higher than 0.7.

One problem which occurs is that as Rotor Inlet Temperature RIT increases, blade tip erosion may surface as a weak point in the design of a high pressure turbine blade.

SUMMARY OF THE INVENTION

Accordingly, there is provided in accordance with the present invention a tip cooling system which helps prevent blade tip erosion.

In accordance with the present invention, there is provided a turbine engine component. The turbine engine component broadly comprises an airfoil portion having a pressure side, a suction side, a leading edge, a trailing edge, and a tip, a first cooling microcircuit embedded in a pressure side wall, a second cooling microcircuit embedded in a suction side wall, and means for cooling the tip comprising a first tip cooling microcircuit receiving cooling fluid from the first cooling microcircuit and a second tip cooling microcircuit receiving cooling fluid from the second cooling microcircuit.

Other details of the microcircuit cooling and tip blowing system of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
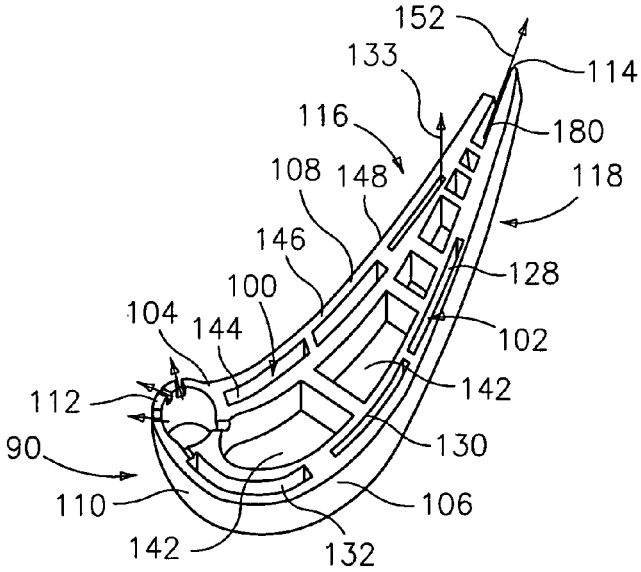
FIG. 1 is a sectional view of an airfoil portion of a turbine engine component having cooling microcircuits in accordance with the present invention.
Figure 2:
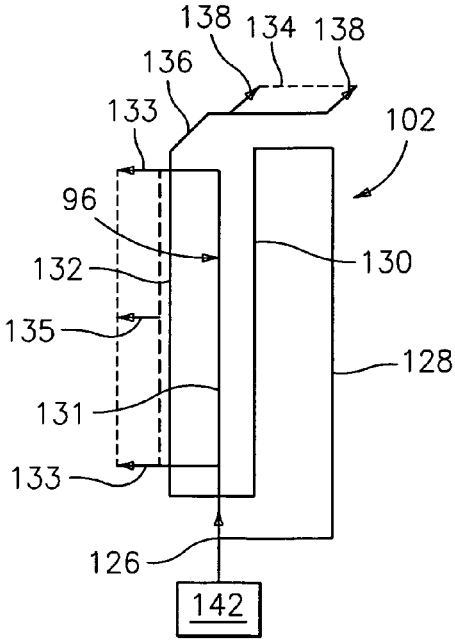
FIG. 2 is a schematic representation of the cooling microcircuit in the suction side of the airfoil portion.
Figure 3:
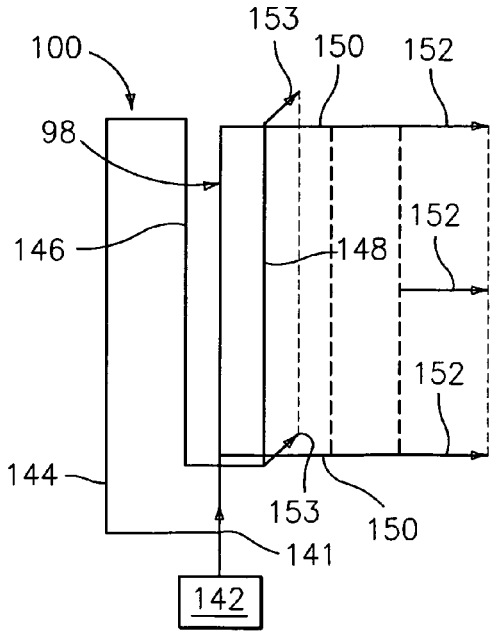
FIG. 3 is a schematic representation of the cooling microcircuit in the pressure side of the airfoil portion.

Referring now to the drawings, a turbine engine component 90, such as a high pressure turbine blade, is cooled using the cooling design scheme of the present invention. The cooling design scheme, as shown in FIG. 1, encompasses two serpentine microcircuits 100 and 102 located peripherally in the airfoil walls 104 and 106 respectively for cooling the main body 108 of the airfoil portion 110 of the turbine engine component. Separate cooling circuits 96 and 98, as shown in FIGS. 2 and 3, may be used to cool the leading and trailing edges 112 and 114 respectively of the airfoil main body 108. One of the benefits of the approach of the present invention is that the coolant inside the turbine engine component may be used to feed the leading and trailing edge regions 112 and 114. This is preferably done by isolating the microcircuits 96 and 98 from the external thermal load from either the pressure side 116 or the suction side 118 of the airfoil portion 110. In this way, both impingement jets before the leading and trailing edges become very effective because they are supplied with relatively low-temperature cooling air. In the leading and trailing edge cooling microcircuits 96 and 98 respectively, the coolant may be ejected out of the turbine engine component by means of film cooling.

Referring now to FIG. 2, there is shown a serpentine cooling microcircuit 102 that may be used on the suction side 118 of the turbine engine component. As can be seen from this figure, the microcircuit 102 has a fluid inlet 126 adjacent a root portion 143 of the airfoil portion 110 for supplying cooling fluid to a first leg 128. The inlet 126 receives the cooling fluid from one of the feed cavities 142 in the turbine engine component. Fluid flowing through the first leg 128 travels to an intermediate leg 130 and from there to an outlet leg 132. Fluid supplied by one of the feed cavities 142 may also be introduced into the cooling circuit 96 and used to cool the leading edge 112 of the airfoil portion 110. The cooling circuit 96 may include fluid passageway 131 having fluid outlets 133. Still further, if desired, fluid from the outlet leg 142 may be used to cool the leading edge 112 via an outlet passage 135. As can be seen, the thermal load to the turbine engine component may not require film cooling from each of the legs that form the serpentine peripheral cooling microcircuit 102. In such an event, the flow of cooling fluid may be allowed to exit from the outlet leg 132 at the tip 134 by means of film blowing from the pressure side 116 to the suction side 118 of the turbine engine component. As shown in FIG. 2, the outlet leg 132 may communicate with a passageway 136 in the tip 134 having fluid outlets 138.

Referring now to FIG. 3, there is shown the serpentine cooling microcircuit 100 for the pressure side 116 of the airfoil portion 110. As can be seen from this figure, the microcircuit 100 has an inlet 141 adjacent the root portion 143 of the airfoil portion 110, which inlet 141 communicates with one of the feed cavities 142 and a first leg 144 which receives cooling fluid from the inlet 141. The cooling fluid in the first leg 144 flows through the intermediate leg 146 and through the outlet leg 148. As can be seen, from this figure, fluid from the feed cavity 142 may also be supplied to the trailing edge cooling circuit 98. The cooling microcircuit 98 may have a plurality of fluid passageways 150 which have outlets 152 for distributing cooling fluid over the trailing edge 114 of the airfoil portion 110. The outlet leg 148 may have one or more fluid outlets 153 for supplying a film of cooling fluid over the pressure side 116 of the airfoil portion 110 in the region of the trailing edge 114.

It should be noted that the cooling microcircuit scheme of FIGS. 1-3 is completely different from existing designs where a dedicated cooling passage, denoted as a tip flag is employed for cooling the tip 134.

Also as shown in FIGS. 1-3, the pressure side 116 of the airfoil main body 108 is cooled with a serpentine microcircuit 100 located peripherally in the airfoil wall 104. In this case, a flow exits in a series of film cooling slots 153 close to the aft side of the airfoil 110 to protect the airfoil trailing edge 114.

If desired, each leg 128, 130, 132, 144, 146, and 148 of the serpentine cooling microcircuits 100 and 102 may be provided with one or more internal features (not shown), such as pedestals and/or trip strips, to enhance the heat pick-up and increase the heat transfer coefficients characteristics inside the cooling blade passage(s).

Figure 4:
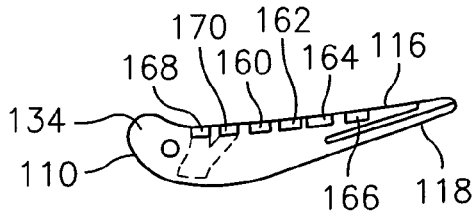
FIG. 4 is a view of a tip of an airfoil portion in accordance with a first embodiment of the present invention.

FIG. 4 shows a tip view of the airfoil portion 110. As can be seen from the figure, there are two microcircuit feeds 160 and 162 from the pressure side microcircuit 100, two feeds 164 and 166 from a trailing edge microcircuit 180, and two feeds 168 and 170 from the suction side microcircuit 102 to the tip 134 for tip cooling and tip blowing. As can be seen from this figure, the feeds 160, 162, 164, 168, and 170 are positioned closer to the pressure side 116 than the suction side 118.

Figure 5:
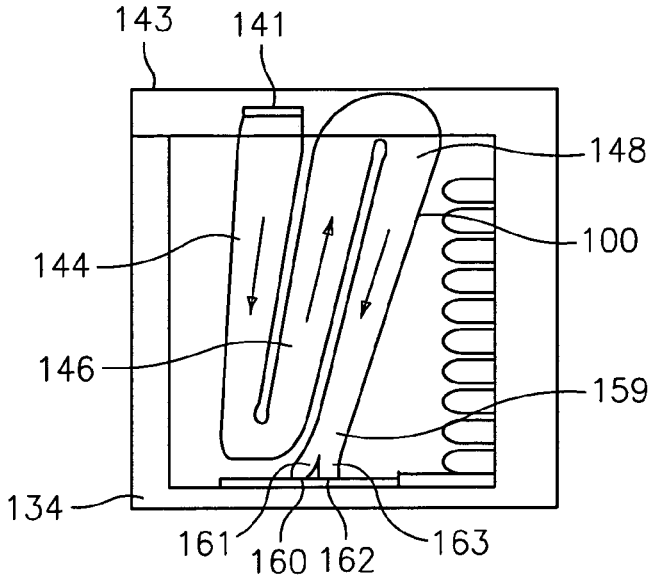
FIG. 5 is a schematic representation of the pressure side microcircuit.

FIG. 5 illustrates the pressure side microcircuit 100 and a first tip microcircuit 159 having a first channel 161 and a second channel 163 connected to the leg 148 and two feeds 160 and 162 connected respectively to the channels 161 and 163.

Figure 6:
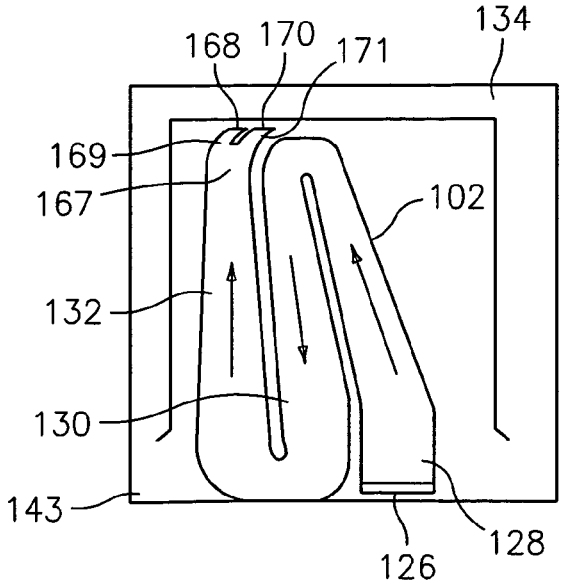
FIG. 6 is a schematic representation of the suction side microcircuit.

FIG. 6 illustrates the suction side microcircuit 102 and a second tip cooling microcircuit 167 having a first channel 169 and a second channel 171 connected to the leg 132 and two feeds 168 and 170 connected respectively to the channels 169 and 171.

Figure 7:
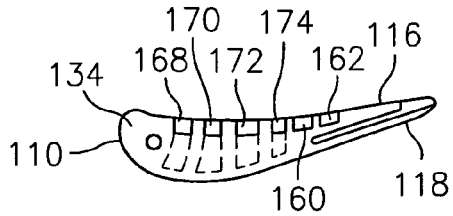
FIG. 7 is a view of a tip of an airfoil portion in accordance with a second embodiment of the present invention.
Figure 8:
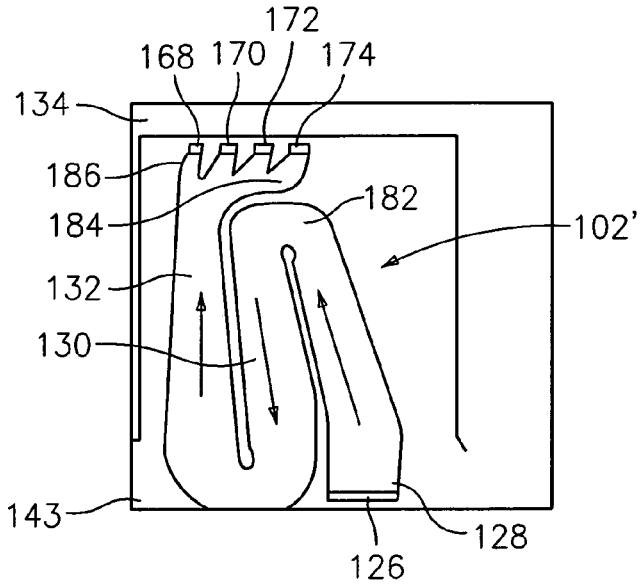
FIG. 8 is a schematic representation of the suction side microcircuit.
Figure 9:
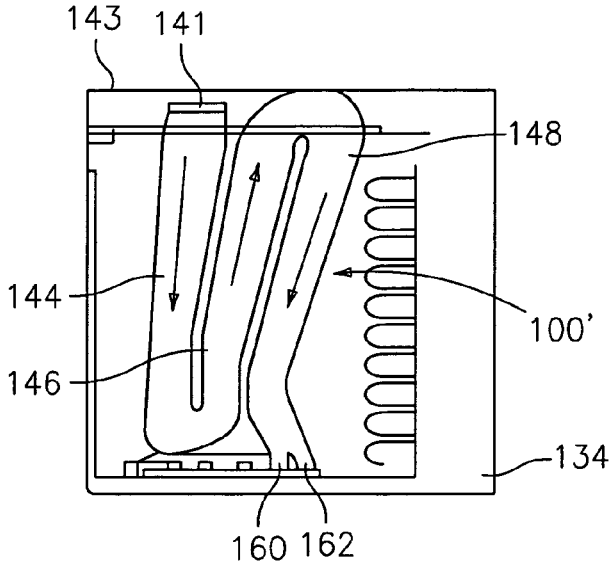
FIG. 9 is a schematic representation of the pressure side microcircuit.

FIGS. 7-9 illustrate another cooling system for cooling the tip 134. As shown in this figure, the tip 134 has four feeds 168, 170, 172 and 174 from the suction side microcircuit 102' and two feeds 160 and 162 from the pressure side microcircuit 100'. As shown in FIG. 8, to accommodate the four exits 168, 170, 172 and 174, there is a one hundred eighty degree turn 182 between the first and second legs 128 and 130 which is placed at a lower radial height. The pressure loss through the ninety degree exit turn 184 to the tip 134 assists in distributing the cooling air out of all four exits 168, 170, 172, and 174. As the coolant flows through the tip microcircuit 186, it eventually exits at the pressure side giving rise to tip (film) blowing covering the tip 134 with a blanket of cooling air over the tip 134.

In accordance with the present invention, the tip of the airfoil portion of the turbine engine component is being cooled with existing main-body cooling air; thus, maintaining the cooling flow at low levels. The cooling system of the present invention allows for tip blowing on the pressure side of the tip to be fed from 3-pass main body peripheral serpentine microcircuits. This tip blowing provides convective and film cooling for the tip region. It can also be utilized from an aerodynamic performance benefit due to a decrease in tip leakage losses. The manufacturing process is reduced in terms of complexity with the compact design of the present invention.

It is apparent that there has been provided in accordance with the present invention a microcircuit cooling and tip blowing system which fully satisfies the objects, means, and advantages set forth hereinbefore. While the present invention has been described in the context of specific embodiments thereof, other unforeseeable alternatives, modifications, and variations may become apparent to those skilled in the art having read the foregoing description. Accordingly, it is intended to embrace those alternatives, modifications, and variations as fall within the broad scope of the appended claims.

What is claimed is:

1. A turbine engine component comprising:

an airfoil portion having a pressure side, a suction side, a leading edge, a trailing edge, and a tip;

a first cooling microcircuit embedded in a pressure side wall;

a second cooling microcircuit embedded in a suction side wall;

means for cooling said tip comprising a first tip cooling microcircuit receiving cooling fluid from said first cooling microcircuit and a second tip cooling microcircuit receiving cooling fluid from said second cooling microcircuit;

said first tip cooling microcircuit having a plurality of feeds and said second tip cooling microcircuit having a plurality of feeds; and said feeds being positioned closer to said pressure side than said suction side.

2. The turbine engine component according to claim 1, wherein each of said first and second tip cooling microcircuits has two feeds.

3. The turbine engine component according to claim 1, wherein said first tip cooling microcircuit has two feeds and said second tip cooling microcircuit has four feeds.

4. The turbine engine component according to claim 1, further comprising a trailing edge cooling microcircuit and said cooling means further comprising two feeds for receiving cooling fluid from said trailing edge cooling microcircuit.

5. The turbine engine component according to claim 1, wherein said first cooling microcircuit comprises a three pass serpentine cooling arrangement.

6. The turbine engine component according to claim 5, wherein said first cooling microcircuit has an inlet adjacent a root portion of said airfoil portion, a first leg for receiving cooling fluid from said inlet, a second leg for receiving cooling fluid from said first leg, and a third leg for receiving cooling fluid from said second leg.

7. The turbine engine component according to claim 6, wherein said first tip cooling microcircuit comprises a first channel connected to said third leg of said first cooling microcircuit and a second channel connected to said third leg of said first cooling microcircuit.

8. The turbine engine component according to claim 1, wherein said second cooling microcircuit comprises a three pass serpentine cooling arrangement.

9. The turbine engine component according to claim 8, wherein said second cooling microcircuit has an inlet adjacent a root portion of said airfoil portion, a first leg for receiving cooling fluid from said inlet, a second leg for receiving cooling fluid from said first leg, and a third leg for receiving cooling fluid from said second leg.

10. The turbine engine component according to claim 9, wherein said second tip cooling microcircuit comprises a first channel connected to said third leg of said second cooling microcircuit and a second channel connected to said third leg of said second cooling microcircuit.

11. The turbine engine component according to claim 9, wherein said second tip cooling microcircuit comprises four channels connected to said third leg of said cooling microcircuit.

12. The turbine engine component according to claim 11, wherein said second cooling microcircuit has a 180 degree turn between said first leg and said second leg and said 180 degree turn is positioned at a radial height which allows accommodation of said four channels.

13. The turbine engine component according to claim 1, wherein said turbine engine component comprises a turbine blade.

* * * * *